US005162032A

United States Patent [19]

Dohner

[11] Patent Number: 5,162,032

[45] Date of Patent: Nov. 10, 1992

[54] RESISTANCE DEVICE FOR USE WITH IN-LINE ROLLER SKATES

[76] Inventor: Craig M. Dohner, 1311 12th Ave., Sterling, Ill. 61081

[21] Appl. No.: 723,849

[22] Filed: Jul. 1, 1991

[51] Int. Cl.[5] ..... A63B 21/065

[52] U.S. Cl. ..... 482/105

[58] Field of Search ..... 272/70, 119; 482/105, 482/51, 93, 139

[56] References Cited

U.S. PATENT DOCUMENTS

| | | | |
|---|---|---|---|
| 3,278,184 | 10/1966 | Rosenbaum | 482/105 |
| 3,306,610 | 2/1967 | Biggs, Jr. et al. | 482/105 |
| 3,427,020 | 2/1969 | Montour et al. | 482/105 |
| 3,528,652 | 1/1971 | Tarbox | 272/119 |
| 3,582,067 | 6/1971 | Rocks | 482/105 X |
| 4,192,502 | 3/1980 | Owen | 482/105 |
| 4,556,215 | 12/1985 | Tarbox et al. | 272/119 |
| 4,777,743 | 10/1988 | Roehrig, Jr. | 482/105 X |
| 4,838,546 | 6/1989 | Winston | 482/105 |
| 4,997,183 | 3/1991 | Winston | 272/119 |

*Primary Examiner*—Robert Bahr
*Attorney, Agent, or Firm*—Dick and Harris

[57] ABSTRACT

A resistance device for use with a foot covering comprises an elongated member having a top edge and a bottom edge. An attaching device is disposed on the elongated member. The bottom edge of the elongated member is of greater length than the top edge. Weight receiving chamber structures are disposed on the elongated member in such a position so that weighting material is symmetrically distributed therein about a latitudinal center line of the elongated member. The attaching device is capable of transforming the elongated member into a closed curve of sufficient size to accept an upper portion of a foot covering with the weighting material received in the chamber structures being disposed on lateral and medial sides of the foot covering. The elongated member assumes a generally frusto-conical shape when mounted on the upper portion of the foot covering.

6 Claims, 2 Drawing Sheets

RESISTANCE DEVICE FOR USE WITH IN-LINE ROLLER SKATES

BACKGROUND OF THE INVENTION

The present invention relates generally to a resistance device for use with a foot covering constructed so as to be attachable to the foot covering in such a manner that the resistance device conforms to the external configuration of the foot covering. The invention more specifically relates to a Speed Weight TM Trainer for use with in-line roller skates or other athletic devices employing similar foot coverings, having a substantially arcuate external construction which can wrap around and conform to the external shape of a athletic device boot.

The modern world has become enchanted, almost to the point of obsession, with physical fitness. People are constantly in search of new and better ways to become physically fit, or to "get in shape." Accordingly, there is a high demand for new and innovative exercise equipment and other devices which increase the fruits of one's exercising efforts. Additionally, members of professional sports teams often look for new training devices that may possibly increase their performance during a game. Thus, the market for exercise equipment and other device experiences a constantly high demand.

Many various exercise devices populate the market. A recent addition to that market has been the device commonly known by the trademark ROLLER BLADE. Roller blades TM, or in-line roller skates, are constructed to mimic ice skates, or other similar devices, in performance. In-line roller skates are similar to roller skates, with the exception that in-line roller skates have one unitary row of wheels, as opposed to the tandem rows present on roller skates. In this fashion, in-line roller skates allow a user to engage in ice skating activity without the need of ice.

The unitary row of wheels is attached to the bottom, or sole of a boot, which is constructed similarly to a boot of an ice skate. In-line roller skates are desirable due to the lack of suitable and available ice for ice skating in certain geographic locations at certain times, and due to the intense physical workout engaged in by a user during ice skating. Also, professionals, as well as other users, desire in-line roller skates because of the different venues available for skating, thereby increasing the enjoyment of the workout.

As with all forms of exercise, people desire to develop progressively, that is begin with a relatively easy workout and, in time, progress to a more difficult workout. In this manner, the user's endurance, strength, and speed are steadily increased.

In the case of in-line roller skates, the present invention provides a resistance device that can increase the difficulty of the skating motion. The preferred method to do this is to attach a weight to the boot of the in-line roller skates, so that the user will have to move that weight in order to skate, thereby increasing the difficulty of the workout, and a user's strength and endurance.

There are devices readily available in the market which attach weights to a user's ankles, appropriately named "ankle weights." Some of the ankle weights of the prior art are shown in FIG. 4. However, these ankle weights are not particularly useful with in-line roller skates, or other types of foot coverings. The ankle weights of the prior art have straight, linear edges, thereby preventing conformity of the ankle weights to the external contours of a in-line roller skate boot or other foot covering. Such ankle weights are designed to encompass a human ankle only, and are thus unable to conform to the boot of a in-line roller skate or other foot covering. Additionally, due to the presence of more than two weight chambers in most ankle weights, they were further prevented from conforming to the contours of a in-line roller skate boot, thereby hampering the appropriate range of motion needed to skate properly. Also, the weight chambers were often stuffed with sand to provide weight, and were prone to rupture, thereby releasing the sand. Accordingly, the ankle weights of the prior art are not practical for such uses as increasing the difficulty of a workout with in-line roller skates, or in other activities using similar boots or foot coverings.

Accordingly, the present invention provides a novel construction of a resistance device, designed for use with in-line roller skates or activities which utilize similar boots or other foot coverings, which can increase a user's strength, speed, and agility. More specifically, the invention provides a Speed Weight TM Trainer which has curved edges, is constructed to conform to the exterior configuration of a in-line roller skate boot, and is of sufficient size so as to accept and conform to the exterior contours of a in-line roller skate. Also, the weight chambers would be oversized with respect to the weighting material so as to facilitate conformity of the weighting material and the Speed Weight TM Trainer with the in-line roller skate boot.

OBJECTS AND SUMMARY OF THE INVENTION

A general object of the present invention is to provide a resistance device for use with a foot covering constructed so as to be attachable to the foot covering in such a manner so that the resistance device conforms closely to the external configuration of the foot covering.

A more specific object of the invention is to provide a Speed Weight TM Trainer for use with in-line roller skates having a substantially arcuate external construction which can wrap around and conform to the shape of a in-line roller skate boot.

Another object of the present invention is to provide a resistance device having sufficient length to encompass and to surround a foot covering.

A further object of the invention is to provide a resistance device having weight receiving chambers arranged so that weight is symmetrically disposed on opposite sides of the foot covering when the resistance device is properly attached.

An additional object of the present invention is to provide a resistance device having a weighting material disposed in a weight chamber in such a manner that the filled weight chambers can form closely around the external contours of a foot covering.

Another object of the invention is to provide a resistance device having a quick release arrangement for attaching and disengaging the resistance device from a foot covering.

A further object of the present invention is to provide a resistance device for use with a foot covering which does not hamper of restrict the range of motion when the resistance device is disposed on the foot covering.

An additional object of the invention is to provide a resistance device for use with a foot covering having weight chambers which are oversized with respect to the weighting material disposed therein so that the weighting material can shift as necessary to allow the filled weight chambers to closely conform to the external contours of the foot covering.

A further object of the invention is to provide a resistance device having weight receiving chambers operably disposed so that when the resistance device is worn and in use, the weighting material is substantially symmetrically disposed along a vertical axis separating the lateral and medial sides of the person's foot, and is further capable of controlled redistribution from one side to the other, to facilitate maximized conformity of the resistance device about the foot covering.

A resistance device, constructed according to the teachings of the present invention, for use with a foot covering comprises an elongated member having a top edge and a bottom edge. Attaching means is disposed on the elongated member. The bottom edge of the elongated member is of greater length than the top edge. Weight receiving chamber means are disposed on the elongated member in such a position so that weighting material is symmetrically distributed therein about a latitudinal center line of the elongated member. The attaching means is capable of transforming the elongated member into a closed curve of sufficient size to accept an upper portion of a foot covering with the weighting material received in the chamber means being disposed on opposite lateral sides of the foot covering. The elongated member assumes a generally frusto-conical shape when mounted on the upper portion of the foot covering.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in connection with the accompanying drawings in which like reference numerals identify like elements, and in which:

DETAILED DESCRIPTION OF AN ILLUSTRATED EMBODIMENT

Figure 1:
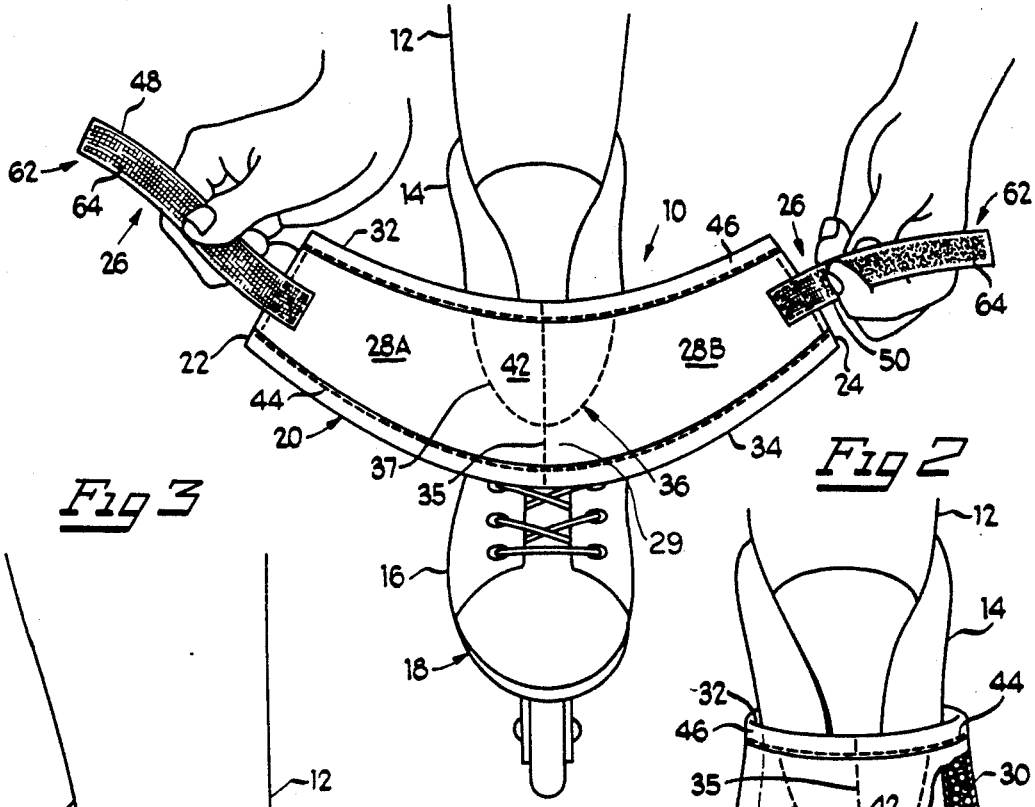
FIG. 1 through FIG. 3 are a series of views illustrating the sequence of a user attaching a resistance device, constructed according to the teachings of the present invention, to a in-line roller skate boot, with portions of the resistance device being broken away to show the close conformity thereof to the shape of the in-line roller skate, and utilizing a hook and loop fastening mechanism to attach the resistance device to the in-line roller skate.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein. The present invention will be described in relation to its employment with in-line roller skates; however, it is to be noted that the invention may be used with other athletic devices employing similar foot coverings.

Figure 2:
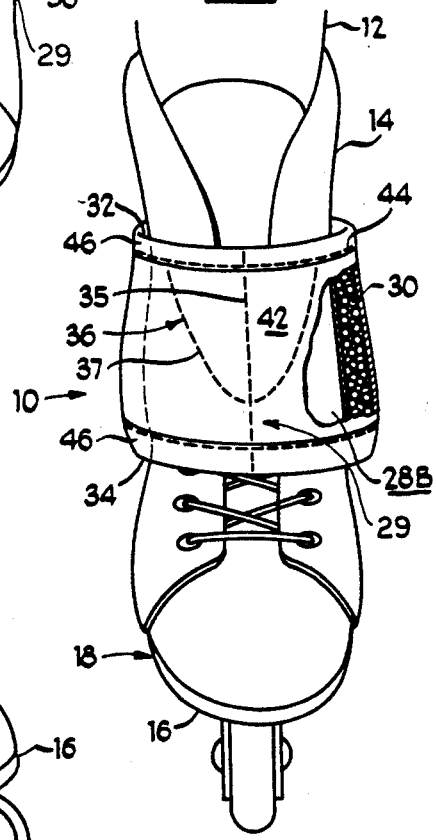
Figure 3:
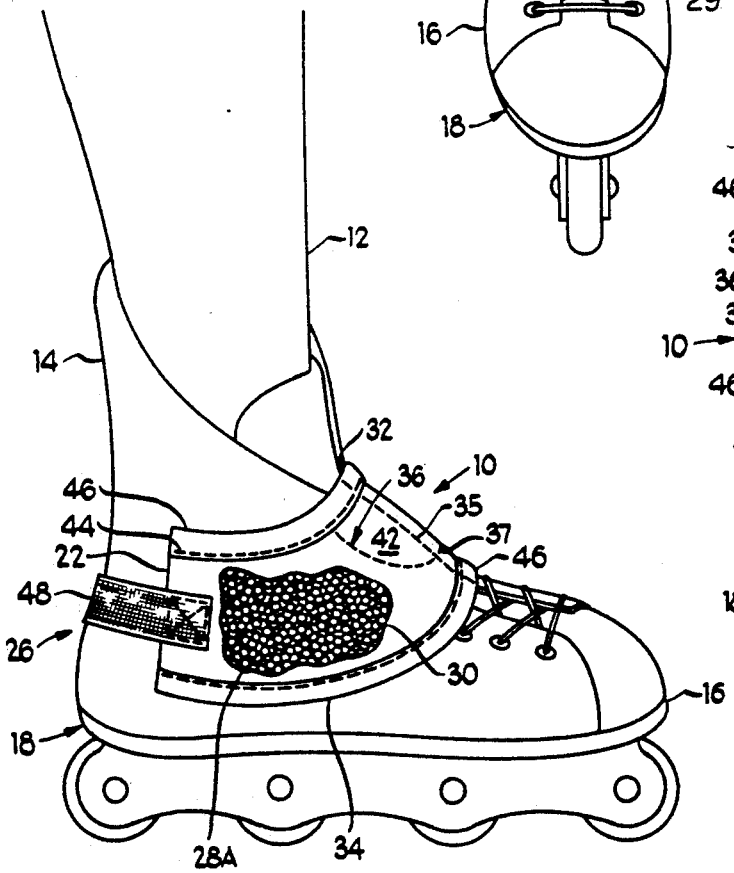
Figure 5:
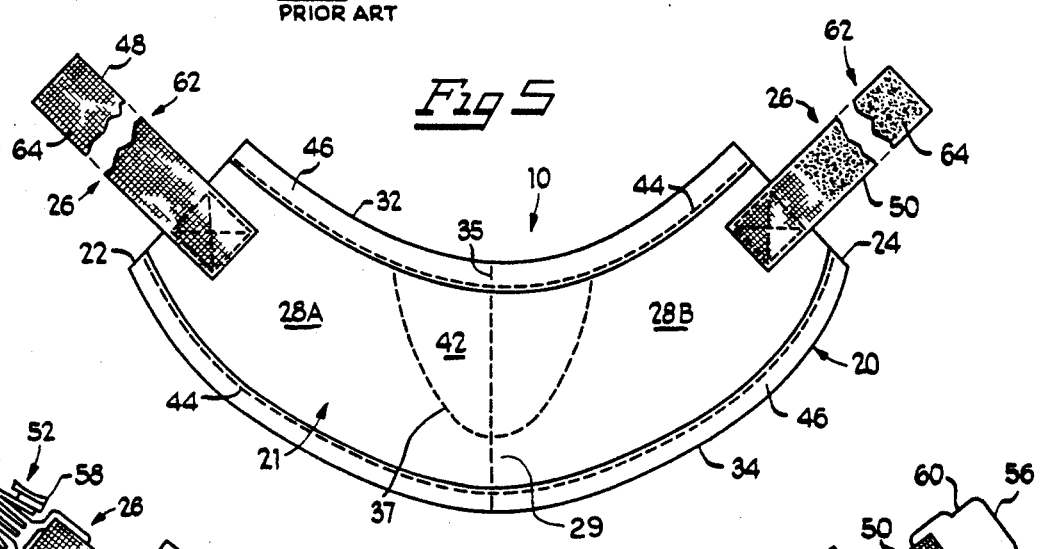
FIG. 5 is an elevational view of the resistance device depicted in FIG. 1 through FIG. 3, with portions broken away to show the disposition of the weights, utilizing a hook and loop fastening mechanism to attach the resistance device to the in-line roller skate.

Referring initially to FIG. 5, a resistance device 10, or a Speed Weight TM Trainer, constructed according to the teachings of the present invention, is shown. Speed Weight TM is a trademark of Craig Dohner, the named inventor of this application. The resistance device 10 is constructed so as to be mountable on a leg 12 of a user about an upper portion 14 of a boot 16 of a in-line roller skate 18, or other foot covering, as shown sequentially in FIG. 1 through FIG. 3. The upper portion 14 of the boot 16 has a generally frusto-conical exterior contour, and it is to this external contour that the resistance device 10 is mounted.

Basically, the resistance device 10 comprises an elongated member 20 having at least a first end 22 and a second end 24 with attaching means 26 disposed on at least one of the ends 22 and 24 so that the resistance device 10 can be mounted firmly on the upper portion 14 of a boot 16. The resistance device 10 can be constructed by sewing as few as two pieces of material. The elongated member 20 also has weight receiving regions or chambers 28A as generally indicated in FIGS. 1 and 5, and connected by weighting material conduit 29, all and 28B capable of holding weighting material 30 therein.

The elongated member 20 is preferably formed from a pair of similar panels or blanks, only one of which is shown in FIG. 5, and designated generally by reference numeral 21. The blank 21 is composed of a relatively lightweight, strong medium, such as a vinyl upholstery material, similar to the material known commercially by the trademark HERCULITE, or the like. The blanks are cut or otherwise formed to the unique shape of the elongated member 20.

As shown in FIG. 5, the elongated member 20 of the resistance device 10 is substantially arcuate in configuration, having a curved, arcuate top edge 32 and a correspondingly similarly shaped bottom edge 34. It is desirable to have this edge configuration so that the resistance device 10 can more accurately conform to the external contours of the in-line roller skate 18, and, more importantly, to the upper portion 14 thereof, thereby providing a snug, secure fit therebetween.

Specifically, the length of the top edge 32 of the elongated member 20 is substantially less than a corresponding length of the bottom edge 34. This construction allows the resistance device 10, when properly mounted on the upper portion 14 of the boot 16 of the in-line roller skate 18, to transform into a substantially frusto-conical shape, corresponding to the generally frusto-conical exterior contour of the upper portion 14.

As mentioned hereinabove, the elongated member 20 is generally of a two-ply construction. This construction forms weight chambers 28A and 28B on the elongated member 20. The weight chambers 28A and 28B form mirror images of each other about a latitudinal center line 35 of the elongated member 20. The top and bottom edges of the weight chambers 28A and 28B are defined by the top edge 32 and the bottom edge 34, respectively.

One side edge of the weight chamber 28A is defined by the first end 22, with a side edge thereof opposite to the one side edge being defined by partition seam 36. The partition seam 36 comprises a strong filament, such as nylon upholstery thread, and the like, sewn through the two-ply construction of the elongated member 20. The weight chamber 28B is constructed in similar fashion, with one side edge thereof being defined by the second end 24, and with a side edge thereof opposite to the one side edge being defined by the partition seam 36. This particular construction assures that the weight chambers 28A and 28B will be disposed symmetrically on opposite sides of the boot 16 of the in-line roller skate 18, thereby facilitating conformity of the elongated member 20 to the upper portion 14 of the boot 16 so that the range of motion of the user during the skating motion will not be restricted.

The weight chambers 28A and 28B are constructed so as to accept and retain weighting material 30, such as lead shot, or the like, and in the particular embodiment shown in FIG. 5, allow the weighting material 30 to communicate therebetween. The size of the shot can be varied, and can be micro-fine if desired. The weighting material 30, shown clearly in FIG. 2 and FIG. 3, increases the resistance to movement of the in-line roller skates 18, thereby increasing the difficulty of the workout, in accordance with the amount thereof contained within the weight chambers 28A and 28B. Lead shot is the preferred weighting material 30 because it provides an optimum amount of weight per unit area inside the weight chambers 28A and 28B economically, and also tends to conform closely to the contours of the upper part 14 of the boot 16.

The partition seam 36 forming the demarcation between the weight chambers 28A and 28B can take on at least two forms. As shown in FIG. 5, the middle seam 36 can be substantially arcuate in nature. In this construction, the middle seam 36 comprises an arcuate stitch 37 centered on and extending downwardly from top edge 32. The arcuate stitch 37 does not extend the entire distance between the top edge 32 and the bottom edge 34. accordingly, the weight chamber 28A and the weight chamber 28B communicate at the latitudinal center line 35 of the elongated member 10. This construction allows for communication of weighting material 30 from one weight chamber 28A or 28B to another. As may be readily understood, once the wearer has strapped resistance device 10 in place, fluent weighting material 31 will immediately tend to settle downward within weight receiving chambers 28A and 28B, and weight material conduit 29. As the total available volume of weight receiving chambers 28A and 28B, and weight material conduit 29 exceeds the volume required by weighting material 31, weighting material 31 is able to shift and redistribute itself, upon prompting while the user is in motion. This shifting and redistribution will permit resistance device 20 to achieve an even greater conformity to the user's footwear, with better weighting material distribution, increasing the effectiveness of the workout.

Figure 6:
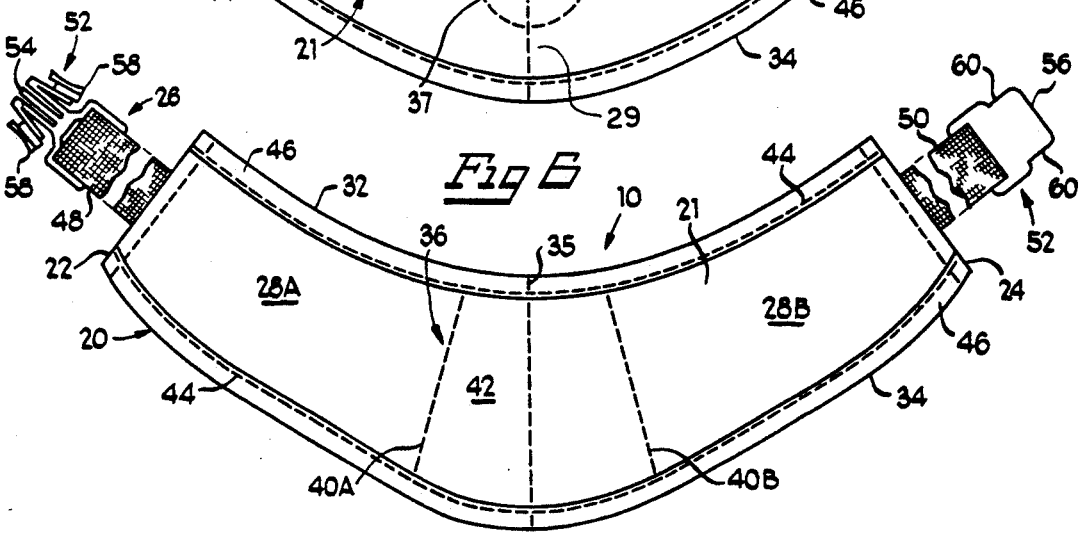
FIG. 6 is a view, similar to the view of FIG. 5, of a second embodiment of a resistance device utilizing a buckle device to attach the resistance device to the in-line roller skate.

In an alternative embodiment of the present invention, as shown in FIG. 6, the middle seam 36 comprises a pair of divergent linear stitches 40A and 40B which are symmetrical about a center line 35 which also preferably carries a stitch, and extend from the top edge 32 to the bottom edge 34. In this construction, the weight chambers 28A and 28B are distinct and separate, thereby preventing any communication of weighting material 30 from one pouch to another.

The linear stitches 40A and 40B form a relatively flexible area 42 therebetween where no weighting material 30 is disposed. Accordingly, this embodiment is particularly well adapted to use with in-line roller skates 18 whose upper portion 14 extends upwardly from the boot 16 at quite a significant angle, thereby demanding a great deal of flexibility from the elongated member 20.

Once the weighting material 30 has been disposed within the weight chambers 28A and 28B, the construction of the resistance device 10 can be completed. The first end 22, the second end 24, the top edge 32, and the bottom edge 34 are closed by at least one stitch 44 piercing through and joining the two-ply construction. The stitch 44 comprises similar material to that comprising the partition seam 36. All but the top edge 32 may be closed by stitch 44, if desired, prior to introducing the weighting material 30. To add additional strength to the resistance device 10, a reinforcing member 46, such as a strip portion comprised of nylon mesh, and the like, is wrapped over and sewn to the top edge 32 and the bottom edge 34. In some constructions, this reinforcing member 46 can be disposed on the entire perimeter of the elongated member 20. While a specific sewing method is described, it is to be noted that alternative sewing methods may also be used in forming the resistance device 10.

The attaching means 26 are also mounted on the elongated member 20. The attaching means 26 generally has at least a first part 48 and a second part 50, and can be composed of a nylon polypropelene or cotton webbing material, and the like. The first part 48 of the attaching means 26 is mounted upon the first end 22 of the elongated member 20, and the second part 50 of the attaching means 26 is mounted on the second end 24 of the elongated member 20. The first part 48 is constructed so as to be firmly connectable with the second part 50 so that the resistance device 10 can form a closed curve and be firmly mounted upon the upper portion 14 of the boot 16.

The attaching means 26 itself can take on at least two forms. As depicted in FIG. 6, the attaching means 26 comprises a buckle or clip mechanism 52 having a male member 54 and a female member 56. The clip mechanism 52 is composed of a flexible, resilient material, such as plastic and the like. The male member 54 is constructed so as to be insertable into the female member 56.

The male member 54 has pins 58 which are compressed when the male member 54 is inserted into the female member 56 initially. When the male member 54 is fully seated in the female member 56, the pins 58 return to their rest position, and project beyond slots 60 in the female member 56, thereby locking the male member 54 inside the female member 56, and causing the elongated member 20 to form a closed curve.

The position of the male member 54 and/or the female member 56 on either the first part 48 or the second part 50, respectively, can be adjusted to vary the effective length thereof to account for varying sizes of the upper portion 14 of different boots 16. Also, a hook and loop connecting mechanism, illustrated in FIG. 5, and similar in construction and operation to a connecting mechanism 62 discussed below, can be attached to a free end of an adjustable portion of the first part 48 or the second part 50 to secure the adjusted position of the male member 54 and/or the female member 56. Accordingly, a single resistance device 10 can be used with many differently sized in-line roller skates 18.

In an alternative embodiment of the present invention, shown in FIG. 5, the clip mechanism 52 is replaced by a hook and loop connecting mechanism 62. The connecting mechanism 62 is comprised of at least two elongated pieces 64 of a hook and loop material, such as that marketed under the trademark VELCRO, disposed on the first part 48 and the second part 50 of the attaching means 26. Either embodiment of the attaching means 26 is an effective method for securing the resistance device 10 to the boot 16 of a in-line roller skate 18. Additionally, pieces of hook and loop material can be used with the clip mechanism 52 as well. In both uses of the hook and loop material, an exact fit between the resistance device 10 and the boot 16 is insured.

Figure 4:
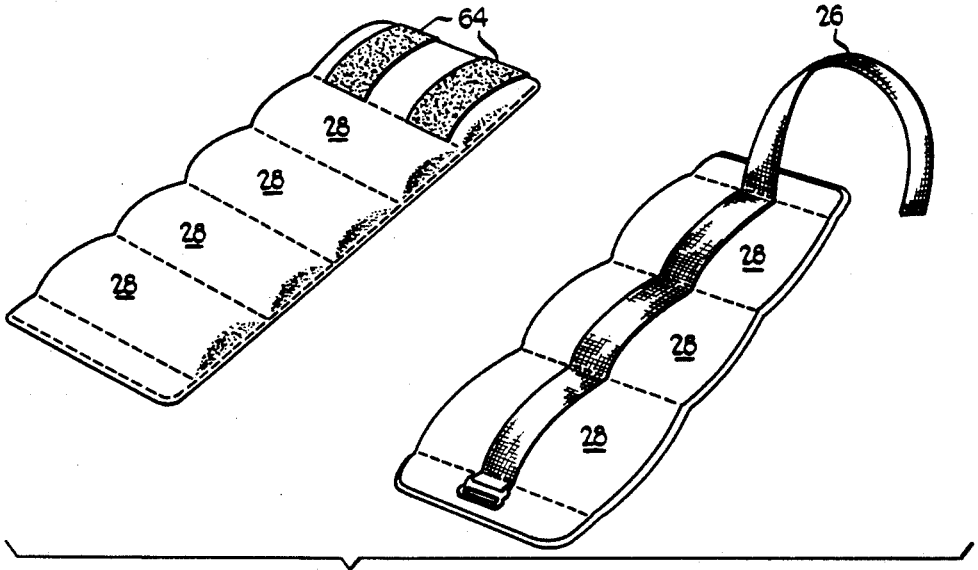
Fig 4 PRIOR ART
FIG. 4 is a plan view of examples of ankle weights of the prior art, showing some of the important differences therebetween.

The resistance device 10, constructed according to the teachings of the present invention, presents numerous advantages over the ankle weights of the prior art. As shown clearly in FIG. 4, the ankle weights of the prior art are substantially rectangular in shape, and are generally too short to encompass a boot of a in-line roller skate TM. Even if the ankle weights were long enough, their rectangular shape prohibits them from becoming substantially frusto-conical in shape when mounted on a boot of a in-line roller skate. Also, the ankle weights have more than two weight chambers, discouraging distribution of the weighting material to allow for easy, uninhibited use of in-line roller skates. Thus, the prior art ankle weights substantially restrict the range of proper skating motion, thereby reducing the effectiveness of a workout. The ankle weights of the prior art are undesirable for use with in-line roller skates, or other athletic devices employing similarly constructed foot coverings.

The Speed Weight TM Trainer 10 is a substantial, and needed, asset to an effective workout with in-line roller skates 18 or other athletic devices employing substantially similar foot coverings. The substantially arcuate configuration of the elongated member 20 allows the Speed Weight TM Trainer 10 to become generally frusto-conical in shape, thus conforming to the external configuration of the upper portion 14 of a boot 16 of a in-line roller skate 18. Also, the Speed Weight TM Trainer 10 has weight chambers 28A and 28B, designed to be disposed on opposite sides of the boot 16. Accordingly, the Speed Weight TM Trainer 10 does not limit the range of available movements during a workout with in-line roller skates 18. Use of the Speed Weight TM Trainer 10 is an effective way for a user to increase his speed, strength, and agility in using in-line roller skates 18, and in performing a skating motion generally, along with the ever-attendant health benefits.

While particular embodiments of the invention have been shown and described in detail, it will be obvious to those skilled in the art that changes and modifications of the present invention, in its various aspects, may be made without departing from the invention on its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A resistance device to be worn over a person's footwear, said resistance device to be positioned over and across said front and top of said person's foot and over said lateral and medial sides of said person's ankle, said resistance device comprising:

a substantially arcuate elongated member having a first end, a second end opposite to said first end, a periphery including a first end edge, a second end edge, a top edge, and a bottom edge, and a vertical axis disposed substantially midway between said first end and said second end, extending vertically between said top edge and said bottom edge;

a first weight receiving chamber containing therewithin substantially fluent weighting material, operably disposed within said elongated member between said first end and said vertical axis;

a second weight receiving chamber containing therewithin substantially fluent weighting material, operably disposed within said elongated member between said second end and said vertical axis, each of said first and second weight receiving chambers having a height extending substantially from said top edge to said bottom edge of said elongated member;

weighting material conduit means, operably disposed substantially between and communicating said first weight receiving chamber with said second weight receiving chamber so as to be substantially positionable over said person's foot instep, said weighting material collectively positioned in said first and second weight receiving chambers and said weighting material conduit means, occupying a total volume substantially less than said total available collective volume of said first and second weight receiving chambers and said weighting material conduit means, said weighting material conduit means being further operably disposed to extend from said bottom edge of said elongated member and having a height no greater than one-half the distance from said bottom edge of said elongated member to said top edge of said elongated member along said vertical axis, so as to enable controlled redistributing movement of said fluent weighting material between said first weight receiving chamber and said second weight receiving chamber; and attaching means operably associated with said arcuate elongated member for removably affixing said resistance device over said footwear and about said person's upper foot and ankle.

2. The apparatus according to claim 1, in which said weighting material conduit means is formed from:

partition seam means, operably extending in a convex manner from said top edge, toward, but not to, said bottom edge of said elongated member, so as to partition said elongated member into said first and second weight receiving chambers connected by said weighting material conduit means, as well as into a convex shaped void region, said void region being completely enclosed by said arcuate path and a portion of said top edge, with said void region being substantially free of weighting material.

3. A resistance device for use with a foot covering according to claim 1 wherein the first weight chamber is a mirror image of the second weight chamber about an axis of symmetry of the arcuate elongated member.

4. A resistance device for use with a foot covering according to claim 1 and further comprising:

a reinforcing member disposed about the periphery of the arcuate elongated member for strengthening structural integrity of the resistance device.

5. A resistance device for use with a foot covering according to claim 1 wherein the attaching means comprises:

a clip mechanism having a male member and a female member.

6. A resistance device for use with a foot covering according to claim 1 wherein the attaching means comprises:

a connecting mechanism including pieces of hook and loop material.

* * * * *

UNITED STATES PATENT AND TRADEMARK OFFICE

CERTIFICATE OF CORRECTION

PATENT NO. : 5,162,032

DATED : November 10, 1992

INVENTOR(S) : Craig M. Dohner

It is certified that error appears in the above-identified patent and that said Letters Patent is hereby corrected as shown below:

| | |
|---|---|
| Col. 4, Line 30 | After "28A", insert — and 28B —. |
| Col. 4, Line 32 | Delete "and 28B". |

Signed and Sealed this

Thirtieth Day of November, 1993

*Attest:*

*Attesting Officer*

Bruce Lehman

BRUCE LEHMAN

*Commissioner of Patents and Trademarks*